US005495670A

United States Patent [19]

Quinn

[11] Patent Number: 5,495,670

[45] Date of Patent: Mar. 5, 1996

[54] UTILITY KNIFE

[75] Inventor: Charles E. Quinn, Sun Prairie, Wis.

[73] Assignee: Fiskars Inc., Madison, Wis.

[21] Appl. No.: 434,478

[22] Filed: May 4, 1995

[51] Int. Cl.[6] ..... B26B 1/08

[52] U.S. Cl. ..... 30/162; 30/125; 30/335

[58] Field of Search ..... 30/151, 162, 125, 30/335

[56] References Cited

U.S. PATENT DOCUMENTS

| | | | |
|---|---|---|---|
| D. 217,583 | 5/1970 | Swanson | D8/107 |
| D. 254,243 | 2/1980 | Florian et al. | D8/98 |
| D. 260,358 | 8/1981 | Wilson et al. | D8/98 |
| D. 311,854 | 11/1990 | Wilson et al. | D8/98 |
| D. 346,542 | 5/1994 | Birkholz | D8/98 |
| 3,192,624 | 7/1965 | Gringer | 30/162 |
| 3,577,637 | 5/1971 | Braginetz | 30/162 |
| 3,613,241 | 10/1971 | Allen | 30/294 |
| 3,660,895 | 5/1972 | West | 30/162 |
| 3,660,896 | 5/1972 | Umholtz | 30/162 |
| 3,708,881 | 1/1973 | Bennett | 30/335 |
| 3,872,591 | 3/1975 | Quenot | 30/162 |
| 3,906,625 | 9/1975 | Gringer | 30/125 |
| 4,005,525 | 2/1977 | Gringer | 30/125 |
| 4,240,202 | 12/1980 | Gilbert | 30/162 |
| 4,242,795 | 1/1981 | Rollband et al. | 30/162 |
| 4,509,260 | 4/1985 | Gringer | 30/162 |
| 4,586,256 | 5/1986 | Weimann | 30/162 |
| 4,615,118 | 10/1986 | Ihata | 30/151 |
| 4,621,425 | 11/1986 | Stoutenberg | 30/162 |
| 4,713,885 | 12/1987 | Keklak et al. | 30/162 |
| 4,805,304 | 2/1989 | Knoop | 30/162 |
| 4,868,985 | 9/1989 | Rehm | 30/162 |
| 4,936,014 | 6/1990 | Shaanan et al. | 30/162 |
| 5,025,558 | 6/1991 | Gilbert | 30/162 |
| 5,299,355 | 4/1994 | Boda et al. | 30/162 |
| 5,303,474 | 4/1994 | Keklak et al. | 30/162 |
| 5,337,481 | 8/1994 | Mears | 30/162 |
| 5,337,482 | 8/1994 | Schmidt | 30/162 |
| 5,386,632 | 2/1995 | Schmidt | 30/125 |
| 5,406,707 | 4/1995 | Owens | 30/162 |

FOREIGN PATENT DOCUMENTS

| | | | |
|---|---|---|---|
| 94/04324 | 3/1994 | WIPO | 30/162 |

*Primary Examiner*—Hwei-Siu Payer
*Attorney, Agent, or Firm*—Foley & Lardner

[57] ABSTRACT

A utility knife includes a hollow handle, for retractably housing a blade mounted on a blade carrier. The blade carrier is pivotally coupled to an actuator. A user can extend or retract the blade through a front slot by depressing an actuating button and sliding the actuator along an actuator glideway and blade carrier along a carrier glideway to a desired position. Once in the desired position a resilient member on the actuator urges protrusions on the actuator into engagement with detents provided within the handle. The blade carrier glideway is provided in an non-parallel orientation with respect to the actuator glideway to obtain a beneficial force transmission to the actuator that tends to maintain engagement between the actuator and the detents. A blade guard at least partially surrounds the front slot to resist upward forces on the: blade during cutting, while a carrier guard contacts a portion of the cutting edge of the blade within the handle to protect the carrier from damage by the blade. The blade carrier and the actuator include abutment surfaces for effectively transmitting axial compression forces on the blade from the carrier to the actuator without exerting excessive force on the joint between the carrier and the actuator. The actuator is substantially rigid and is urged into engagement with the detents by a resilient member, thereby avoiding deflection of the actuator as a result of axial compression forces exerted on the blade.

24 Claims, 7 Drawing Sheets

UTILITY KNIFE

BACKGROUND OF THE INVENTION

Field of the Invention

The present invention relates generally to the field of retractable utility knives. More particularly, the invention relates to a utility knife incorporating an improved structure for extending and retracting the knife blade and for resisting forces exerted on the blade during use.

Description of the Prior Art

In response to the need for a sturdy and reliable cutting tool in which a blade can be conveniently shielded to avoid accidental cutting, a considerable number of multi-purpose retractable utility knives have been developed. Popular designs for such knives typically include a hollow handle comprised of two mating halves. When assembled, the handle has a front slot through which a knife blade may be extended and retracted. The blade is typically supported within the handle on a blade carrier movable along a flat guideway. Blade carriers for most popular utility knives are formed integral with a flexible actuating arm, often from an injection molded plastic material. The actuating arm supports a button actuator that protrudes through a second slot in the handle and is urged upwardly into engagement with detents by the spring action of the actuating arm. The handle may typically be dismantled or otherwise opened for loading trapezoidal blades into the blade carrier. A blade mounted in the blade carrier is then extended and retracted through the front slot by pressing the actuating button and sliding the blade carrier forward and backward along its guideway.

A persistent problem associated with retractable utility knives of this type is devising a structure capable of resisting forces imposed on the knife blade during service. In use, the blade typically encounters a number of forces, including axial forces tending to push the blade back into the handle, upwardly directed forces tending to force the blade between the: halves of the handle and the rear of the blade into the blade carrier, and lateral forces tending to twist the blade in the front slot. If the support structure associated with the blade, particularly the handle and blade carrier, fails to adequately resist these forces, the blade may accidentally retract or may split or break the handle, most often in the region bordering the front slot. The rear portion of the blade may also be forced downwardly against the blade carrier, cutting or damaging the carrier.

A number of solutions have been proposed to resist the forces on retractable utility knife blades, with varying degrees of success. To resist axial forces tending to force the blade into the handle, many known designs employ a detent arrangement wherein protrusions from the actuating arm lodge into one of a series of notches on an inner surface of the handle. A utility knife generally of this type is described in U.S. Pat. No. 4,509,260 issued on Apr. 9, 1985 to Gringer. In such arrangements, axial forces exerted on the blade are transmitted through the actuating arm to the detent notches. However, because the actuating arm must be inherently spring-like to permit movement of the actuating button and to urge the actuating arm into engagement with corresponding notches, forces on the blade may cause flexure of the actuating arm, resulting in undesirable axial movement of the blade during use. Thus, while these designs have the advantage of being simple to manufacture and have few separate parts, they do not always provide adequate resistance to axial forces. In addition, because such designs rely on the resilience of the actuating arm itself to engage the detent arrangement, their effectiveness in resisting axial forces may be reduced at certain blade positions where engagement of the actuating arm into the notches is reduced or as the actuating arm gradually relaxes or deforms over time.

Several alternative utility knife designs have also been proposed for controlling the upward and side movement of the knife blade. In one known design, described in U.S. Pat. No. 5,025,558 issued on Jun. 25, 1991 to Gilbert, the knife handle comprises two mating halves having interlocking wedge portions that cross the centerline of the handle. The interlocking wedges prevent the handle from splitting as a result of upward forces on the blade during cutting. In another approach, described in U.S. Pat. No. 5,386,632 issued on Feb. 7, 1995 to Schmidt, the knife blade is mounted in a channel-shaped carrier that is, in turn, received within a channel-type holder of a single-piece knife handle. While these structures generally avoid splitting of the knife handle under upwardly directed forces resulting from cutting action, they are somewhat complex and can be difficult to manufacture and assemble. Moreover, replacement of the cutting blade in these structures can be rather time consuming, requiring partial dismantling of the knife. Furthermore, because the blade carriers for such knives are typically made of an injection molded plastic material, they do not address the problem of resisting pressure from the rear portion of the blade on the base of the carrier.

To withstand and resist twisting forces on retractable blades, many known utility knives typically comprise a two-part metal handle including two handle halves joined along a centerline by screws or other removable attachment devices. The profiles of the front end of each handle half typically define the front slot through which the blade is extended and retracted. Under twisting forces, the blades of such knives bear against the portions of the handle surrounding the front slot. Other known utility knives, such as the knife described in U.S. Pat. No. 5,386,632 mentioned above, employ mutually opposing channel members to hold the knife blade and resist twisting forces. While these arrangements may effectively prevent excessive turning of the knife blade in the front slot, because they rely on the rigidity of the joint between the halves of the handle structure to resist twisting forces, the handles for such knives are typically joined in ways that require dismantling of the handle to load or change blades.

There is a need, therefore, for a retractable utility knife in which a cutting blade may be easily moved between extended and retracted positions, but that resists the axial forces tending to press the blade back into the handle. Moreover, there is a need for a light weight utility knife that resists deflection of the blade by upward and twisting forces during use. In addition to having these features, the knife should be comfortable to use and should permit simple and rapid replacement of blades.

SUMMARY OF THE INVENTION

The present invention features a novel utility knife of the type including a handle and a blade carrier received within the handle for holding and moving a blade between extended and retracted positions. The blade carrier is moved within the handle by depressing a push button, but is solidly locked into selected positions by releasing the button. Axial forces on the extended blade are resisted by positive engagement between the handle and an innovative actuating arm that is pivotally mounted with respect to the carrier. Upward and twisting forces on the blade are also resisted by a guard provided adjacent the front slot and by additional features of the blade carrier. Furthermore, the blade is easily accessible for replacement by opening a front panel to which the guard is preferably attached.

Thus, in accordance with a first aspect of the invention, a utility knife includes a handle, a blade carrier and an actuator. The handle has an internal cavity for housing a retractable blade, a first slot in an end of the handle through which the blade may be extended and retracted, and a carrier glideway extending within the cavity from a point adjacent to the first slot. The blade carrier is configured to support the blade and is movable along the carrier glideway within the cavity. The actuator includes a substantially rigid actuating arm having an end pivotally coupled to the blade carrier and an actuating button movable along a second slot in the handle to extend and retract the blade. The actuator also includes a protrusion engagable in notches formed in the handle for selectively securing the blade in extended and retracted positions.

In accordance with another aspect of the invention, a utility knife includes a handle having a carrier glideway extending from a point adjacent to the first slot and an actuator glideway extending in a non-parallel orientation with respect to the carrier glideway. The knife also includes a blade carrier movable along the carrier glideway and an actuator pivotally coupled to the carrier and slidable along the actuator glideway. The actuator maintains a predetermined orientation with respect to the actuator glideway as the blade is moved between extended and retracted positions.

In accordance with a further aspect of the invention, a utility knife includes a handle, a blade guard, a blade carrier and an actuator. The blade guard is secured to the handle and extends along an upper edge of the slot through which the blade is extended, as well as over at least a portion of the lateral sides of the slot. The blade guard is preferably a closed metal loop supported or formed integrally with an access panel. The access panel is pivotally mounted on the handle and may be opened and closed for mounting and removing blades from the blade carrier.

In accordance with another aspect of the invention, a utility knife includes a handle, a blade carrier, a carrier guard and an actuator. The carrier has a lower ledge for supporting a lower cutting edge of a knife blade and the carrier guard is disposed on the lower ledge of the blade carrier for contacting the cutting edge of the blade, thereby protecting the carrier from damage by the blade.

In accordance with yet another aspect of the invention, a utility knife includes a handle, a blade carrier and an actuator. The blade carrier and the actuator are pivotally coupled to one another by a pivot joint and each includes abutment surfaces for transmitting forces exerted on the knife blade from the carrier to the actuator. The abutment surfaces are separate from the pivot joint, thereby avoiding exertion of excessive forces on the pivot joint.

BRIEF DESCRIPTION OF THE DRAWINGS

These and other features of the invention will be more fully understood by reference to the following description and the appended FIGURES, wherein like reference numerals designate like elements and in which.

DETAILED DESCRIPTION OF THE PREFERRED EMBODIMENTS

Figure 1:
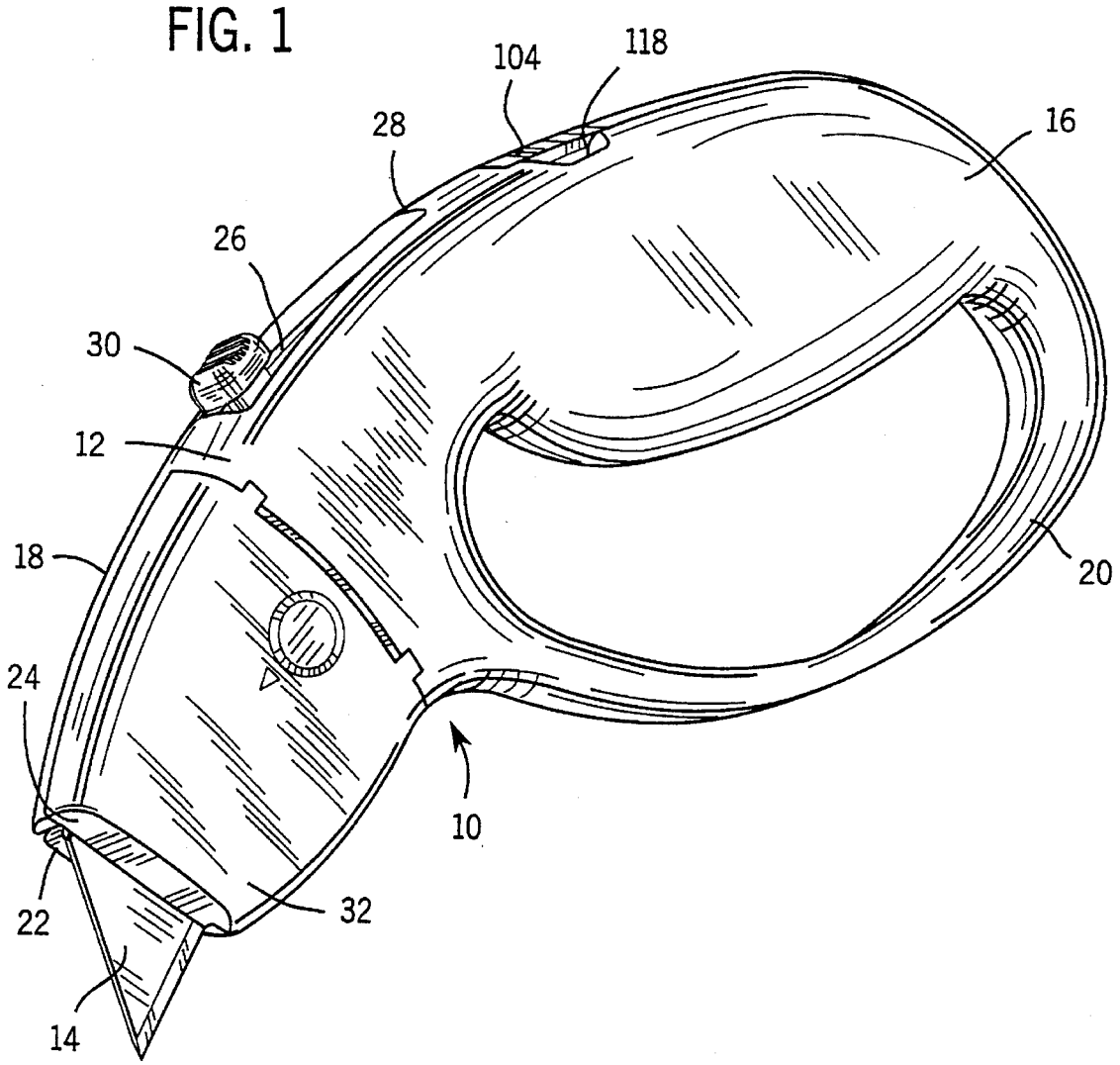
FIG. 1 is a perspective view of an exemplary embodiment of a utility knife in accordance with the present invention.
Figure 2:
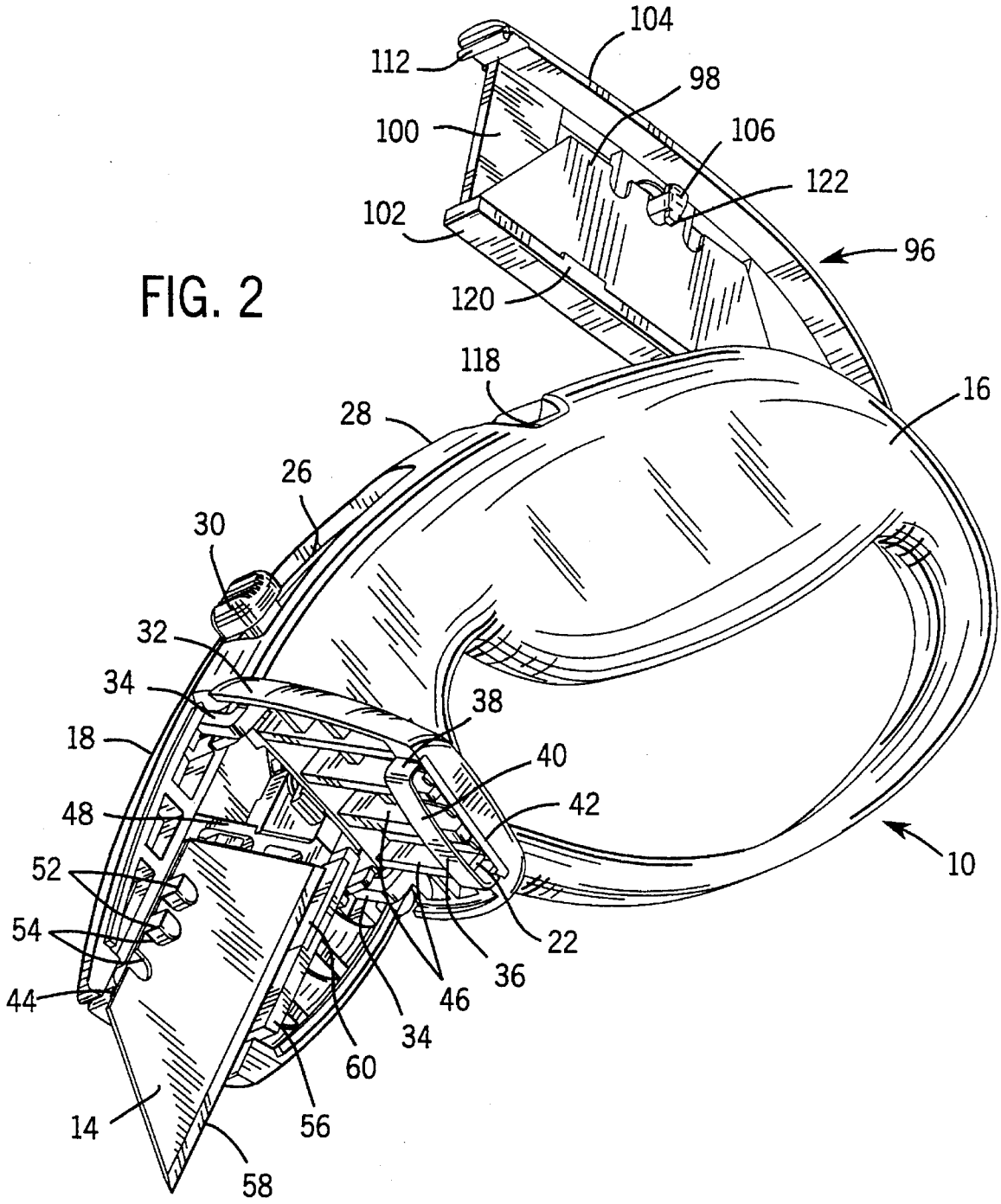
FIG. 2 is a perspective view of the utility knife of FIG. 1, illustrating the open positions of the access panel and the rear spare blade storage compartment.

Turning now to the drawings and referring first to FIGS. 1 and 2, a utility knife 10 includes a generally hollow handle 12 for supporting and housing a retractable blade 14. Handle 12 includes a gripping section 16 and a sheath section 18 designed to retractably hold the blade and resist forces exerted on the blade during various cutting operations. An integral loop 20 is conveniently included on gripping section 16 of the handle to partially surround the fingers of a user during cutting. A first slot 22 is formed in a front end 24 of sheath section 18, while a second slot 26 is formed in handle 12, preferably along an upper edge 28 thereof. An actuating button 30 is slidable along slot 26 to selectively move blade 14 between a retracted position, wherein blade 14 is completely withdrawn into sheath section 18, and an extended position, as illustrated in FIG. 1, wherein blade 14 protrudes through slot 22.

As best illustrated in FIG. 2, utility knife 10 preferably includes an access panel 32 pivotally mounted on handle 12 and movable between a closed position (see FIG. 1) and an open position for loading and changing blades 14. Access panel 32 is retained on handle 12 by a pair of hinges 34, as described in greater detail below, and supports on its front end a blade guard 36. Blade guard 36 at least partially surrounds front slot 22. In particular, to resist upward forces on blade 14 during cutting, blade guard 36 includes an upper portion 38 bordering the upper edge of slot 22 and lateral portions 40, 42 bordering the sides of slot 22. While blade guard 36 may thus be an open structure designed to surround an upper, non-cutting edge 44 of blade 14 as well as a portion of the sides of the blade, it is preferably a closed loop as illustrated in the FIGURES. This closed loop structure assists in resisting side loads on blade 14 during use, as well as forces tending to twist blade 14. Moreover, blade guard 36 is preferably made of a metal, such as steel or zinc. Blade guard 36 may be formed separately from access panel 32 and secured to access panel 32 during assembly of knife 10 or, as in the preferred embodiment shown, may be formed integrally with access panel 32, such as by metal casting. Access panel 32 also includes internal ribs 46 designed to contact and bear against blade 14, thereby acting as a guide or beating surface for blade 14 as it is moved through slot 22. During cutting operations, ribs 46 and blade guard 36 stabilize blade 14 and resist twisting forces on the blade.

Figure 3:
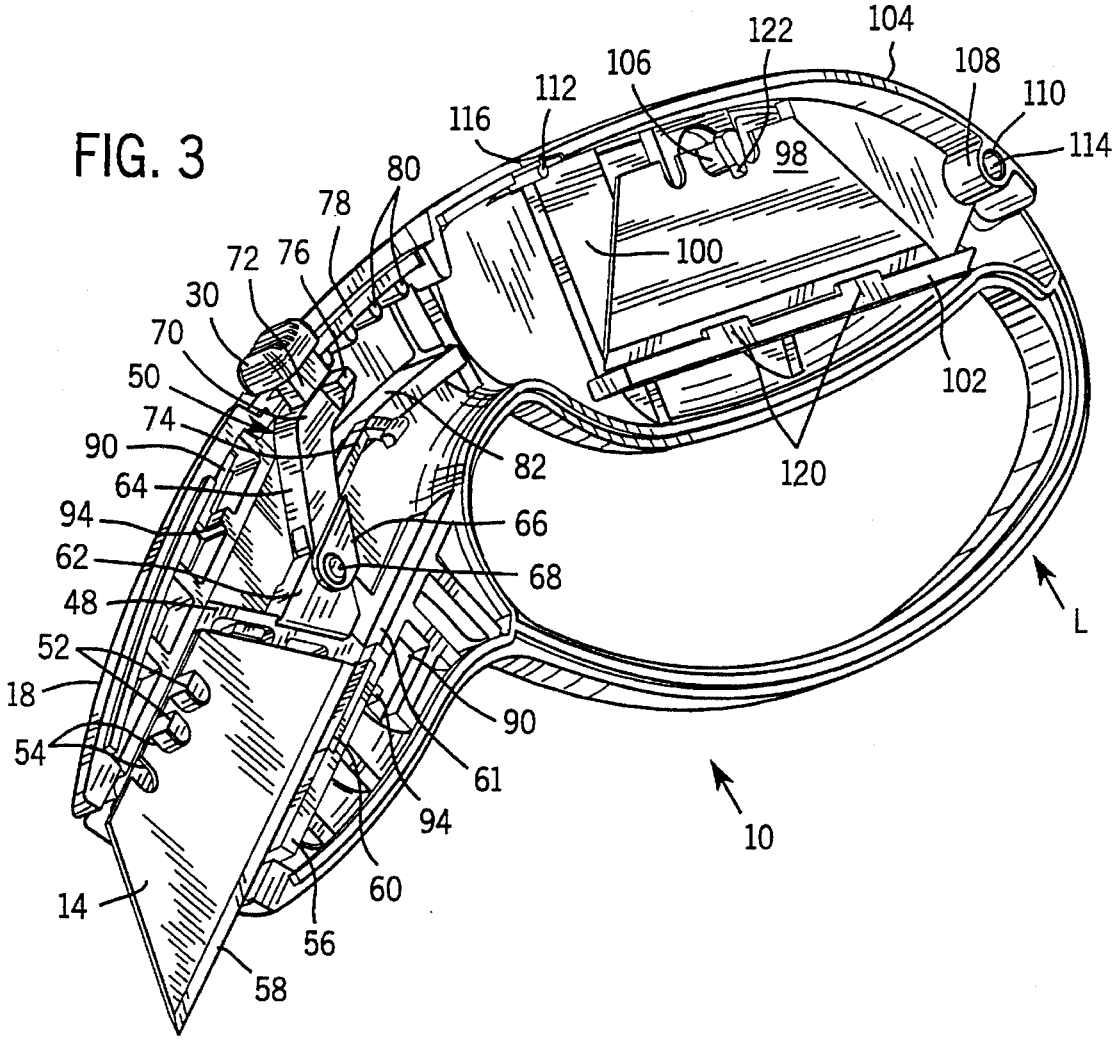
FIG. 3 is a perspective view of the left half of the utility knife of FIG. 1 illustrating the preferred internal configuration of the knife as well as blade carrier and actuator in their blade-extended positions.
Figure 4:
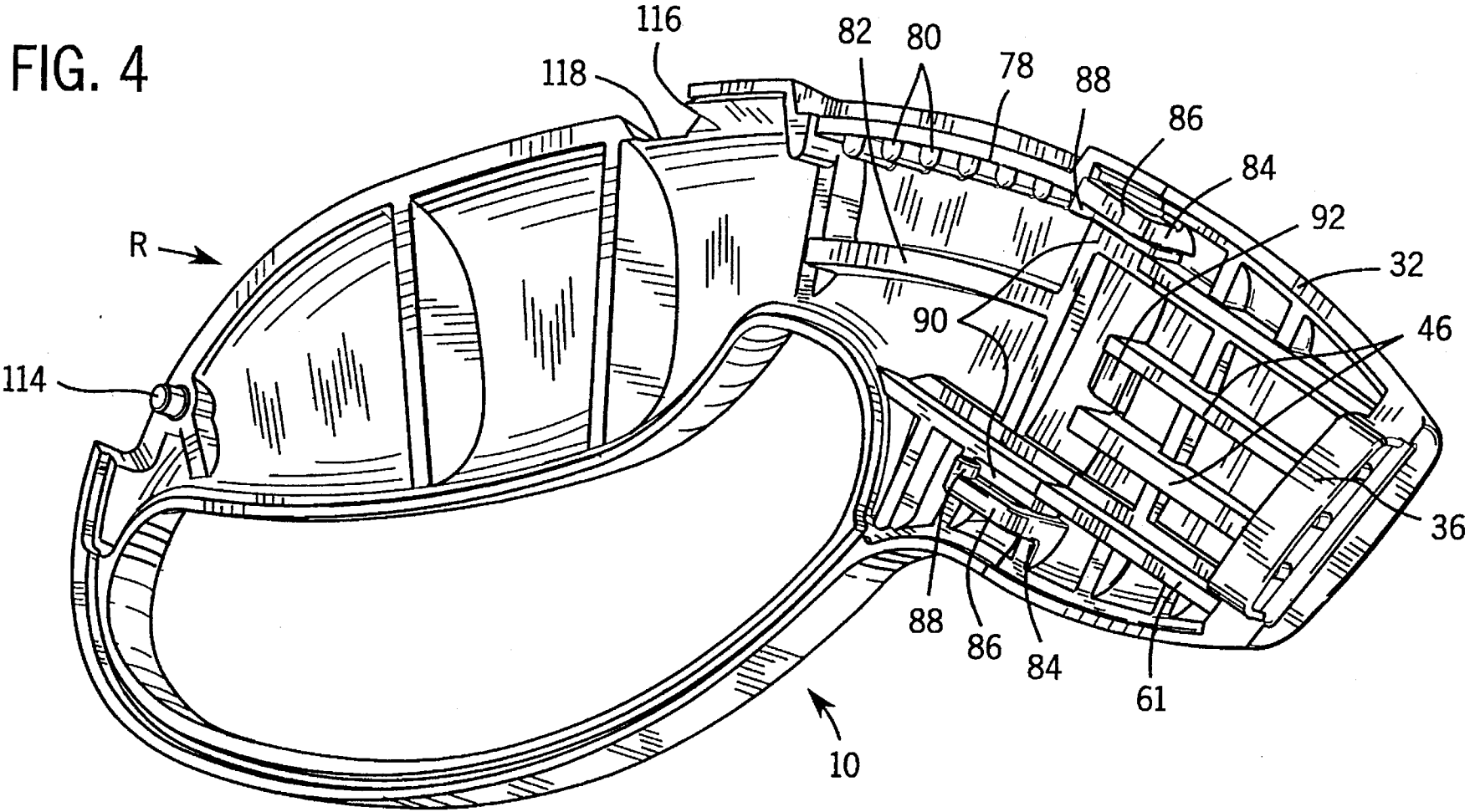
FIG. 4 is a perspective view of right half panel of the utility knife of FIG. 1, illustrating the preferred internal configuration of the knife, including the access panel.

As illustrated in FIGS. 3 and 4, handle 12 preferably comprises two mating shells or halves, including a left half L (FIG. 3) and a right half R (FIG. 4) formed and assembled separately and permanently joined, such as adhesively, or by ultrasonic soldering or any other suitable process. As best shown in FIG. 3, within sheath section 18, utility knife 10 includes a blade carrier 48 configured to receive and support blade 14, as well as an actuator 50 coupled to carrier 48 and cooperating with carrier 48 to extend and retract blade 14 and to resist forces exerted on blade 14. Blade carrier 48 and actuator 50 will be discussed in greater detail below with reference to FIGS. 5 through 8. Generally however, carrier 48 includes a pair of projections 52 extending laterally from the upper edge thereof for engaging corresponding indentations 54 along the upper edge 44 of blade 14. Commercially available blades of the type illustrated commonly include three such indentations. Carrier 48 also includes a lower ledge 56 for supporting a lower cutting edge 58 of blade 14. A carrier guard 60 is supported on carrier 48 adjacent to lower ledge 56. Carrier guard 60, preferably made of metal such as steel, contacts cutting edge 58 of blade 14 to protect lower ledge 56. During use, cutting forces on blade 14 tend to press blade 14 upwardly against projections 52, urging the rear portion of the blade overlying carrier guard 60 downwardly against guard 60. Guard 60 resists such forces and thereby protects lower ledge 56 of carrier 48 from being cut or damaged by blade 14. To support and guide carrier 48 within handle 12, both left and right halves L and R of handle 12 include a flat carrier glideway 61 extending from a point adjacent to slot 22 rearwardly.

Figures 5, 6:
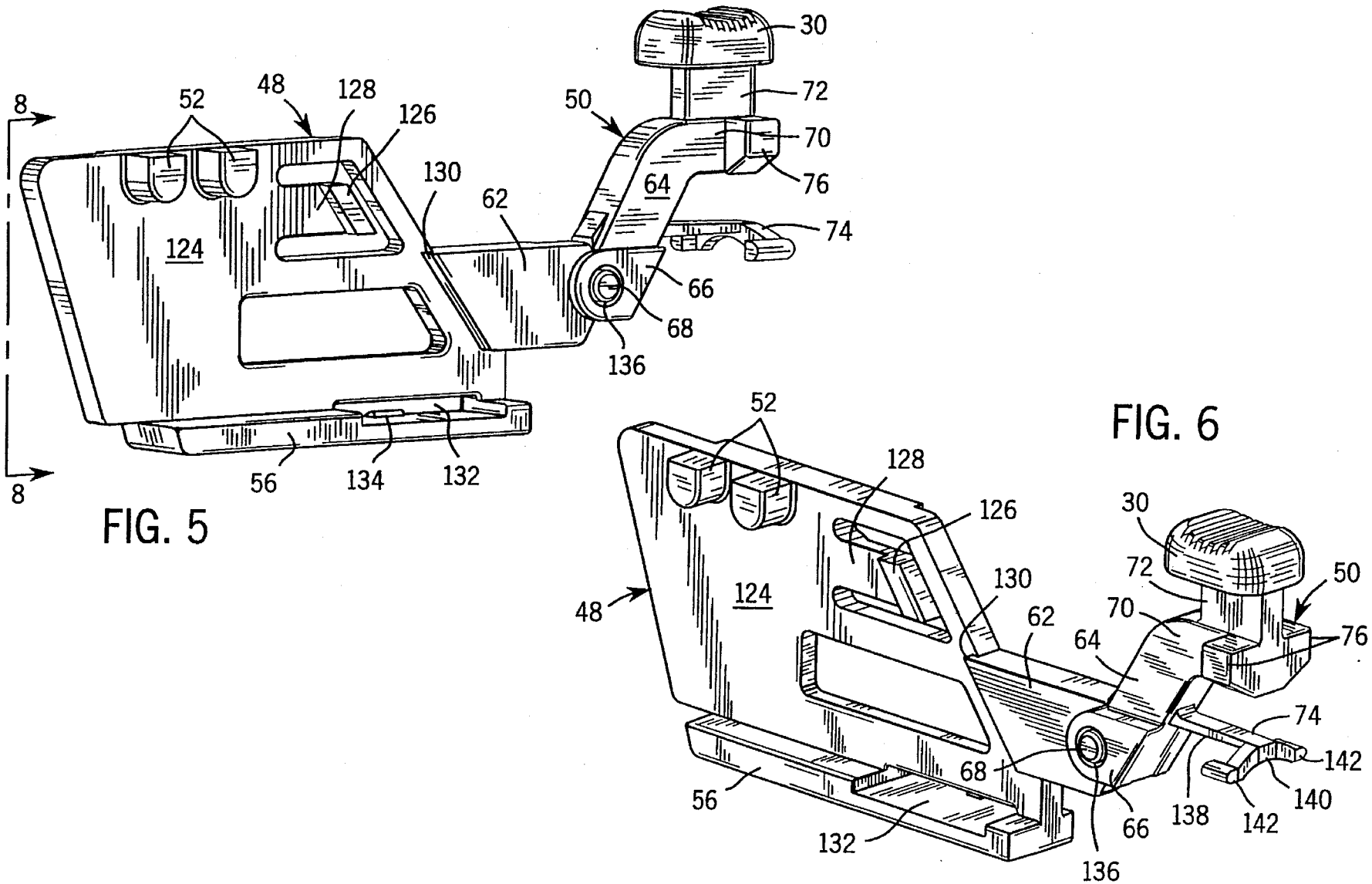
FIG. 5 is a front perspective of the blade carrier and actuating arm of the utility knife of FIG. 1.
FIG. 6 is a rear perspective of the blade carrier and actuating arm illustrated in FIG. 5.

A illustrated in FIG. 5, a rear extension or tab 62 extends from carrier 48 for coupling carrier 48 to actuator 50. Actuator 50 includes a substantially rigid actuating arm 64 having a front end 66 adapted for coupling to tab 62. In the illustrated embodiment end 66 of actuating arm 64 is a clevis fitted around tab 62 and pivotally coupled to tab 62 by a pin 68 that may be formed integrally with tab 62 or added as a separate element during assembly of knife 10. At an upper end of actuating arm 64, actuator 50 includes a support 70 from which an extension 72 extends through slot 26 to support actuating button 30. Below support 70, an integral resilient member 74 extends rearwardly from actuating arm 64 to urge support 70 upwardly. Projections or engagement shoulders 76 extend laterally from support 70 and contact an upper wall 78 of handle 12 on either side of slot 26 (see FIGS. 3 and 4). Detents 80 are formed along upper wall 78 at evenly spaced intervals and engage projections 76 to maintain actuator 50 and carrier 48 at the fully extended and fully retracted positions, as well as at several intermediate positions therebetween. A pair of ribs formed within handle 12 define an actuator glideway 82 (see FIGS. 3 and 4) for guiding and supporting resilient member 74. As will be appreciated by those skilled in the art, the location at which resilient member 74 joins actuating arm 64 will influence the upward force exerted on arm 64 by resilient member 74. Thus, in the design of actuator 50, member 74 may be placed more or less close to end 66 of actuator 50 to obtain a desired degree upward force on actuator 50, thereby providing a desired "feel" to button 30 in response to depressing forces.

In operation, resilient member 74 contacts actuator glideway 82 to urge support 70 upwardly, thereby engaging projections 76 between detents 80 and locking actuator 50,, carrier 48 and blade 14 in place. For retracting and extending blade 14, button 30 is depressed, deflecting resilient member 74 and disengaging projections 76 from detents 80. With button 30 thus depressed, actuator 50, carrier 48 and blade 14 are slid into the desired position by moving actuator 50 along actuator glideway 82 and carrier 48 along carrier glideway 61. Once the desired blade position is reached, button 30 is released to again lock projections 76 between detents 80.

It should be noted that actuator 50 may pivot with respect to carrier 48 when button 30 is depressed and during displacement of actuator 50 and carrier 48 between various positions. However, once actuator 50 is locked into place at a desired blade position, actuator 50 assumes a fixed position relative to carrier 48, thereby resulting in axial forces exerted on blade 14 being transmitted through carrier 48 and actuator 50 to detents 80 of handle 12. Due to the rigidity or stiffness of actuating arm 64, actuator 50 will deflect very little in response to such forces, providing improved stability of blade 14 relative to handle 12. Thus, unlike many conventional retractable utility knife designs, wherein detent engagement is reliant on the inherent resilience of an actuating arm or beam, potentially resulting in undesirable deflection of the actuating arm and retraction of the blade during cutting, projections 76 on actuator 50 in the present utility knife are urged into engagement with detents 80 by resilient member 74, permitting actuating arm 64 to be made sufficiently rigid to avoid deflection as a result of cutting forces.

It should also be noted that as actuator 50 and carrier 48 slide between the blade-extended and blade-retracted positions, their orientations with respect to one another are defined by the respective orientations of actuator glideway 82 and carrier glideway 61. While glideways 82 and 61 may be parallel to one another, as in most conventional retractable utility knife designs, in the present utility knife, they are preferably non-parallel. In the preferred embodiment illustrated, actuator glideway 82 has an arcuate configuration and generally diverges from carrier glideway 61 as the glideways extend toward front end 24 of handle 12. The non-parallel orientation of glideways 82 and 61, in combination with the novel configuration of actuator 50 and carrier 48 offer several advantages with respect to conventional designs. First, displacing the glideways angularly with respect to one another permits gripping section 16 of handle 12 to be angled with respect to sheath section 18, making utility knife 10 more ergonomic and comfortable to use. Moreover, because actuating arm 64 is rigid and pivotally coupled to carrier 48, the orientation of actuator 50 with respect to actuator glideway 82 remains substantially unchanged in the various locked positions of actuator 50, while the orientation of actuator 50 with respect to carrier 48 is free to change as actuator 50 and carrier 48 move along their respective glideways. Thus, the locking function of resilient member 74 in cooperation with projections 76 and detents 80 is generally unreduced as actuator 50 and carrier 48 are advanced toward their blade-extended positions along their respective glideways. In addition, by providing glideways 82 and 61 with a nonparallel orientation with respect to one another, the angle through which carrier 48 transmits force to actuator 50 differs at the blade-extended, blade-retracted and intermediate positions. Thus, by way of example, where glideways 82 and 61 diverge from one another as they extend toward the front end 24 of knife 10, actuator 50 will join carrier 48 at a steeper angle (i.e. closer to 90 degrees) in the blade-extended position than in the blade-retracted position, thereby effectively increasing the component of axial compression forces on blade 14 tending to engage projections 76 between detents 80. While this diverging orientation is preferred, it should be noted that other beneficial effects could be obtained by providing glideways 82 and 61 with a converging orientation as they extend toward front end 24, such as to permit forces from carrier 48 to be transmitted to actuator 50 in a more axial direction in the blade-extended position.

The preferred internal configuration of access panel 32 is illustrated in FIG. 4. As mentioned above, access panel 32 is preferably formed by a metal casting process, such as from zinc, that requires few or no subsequent machining or finishing steps. In addition to blade guard 36 and internal ribs 46 discussed above, access panel 32 includes hinges 34 configured to cooperate with features within handle 10 permitting access panel 32 to pivot between its open and closed positions and to be locked in its closed position. In particular, hinges 34 each include upstanding portions 84 extending from panel 32, rearwardly projecting portions 86 and abutment ends 88 as illustrated. In the closed and locked position shown in FIG. 4, rearwardly projecting portions 86 lie between mutually opposing walls 90 on the inner surfaces of the left and right halves L, R of handle 12. A locking catch 92 extending from right handle half R toward access panel 32 engages a corresponding protrusion (not shown) on the inner surface of access panel 32 by a snapping-type action to retain panel 32 in the locked position. To unlock and open access panel 32, panel 32 is slid forward (i.e. toward front end 24) to disengage or unsnap catch 92 from the protrusion on panel 32 and to remove rearwardly projecting portions 86 from their closed position between walls 90. The forward motion of panel 32 is limited by a pair of stops 94 on the left half of handle 12 (see FIG. 3) that contact abutment ends 88 and, in this forwardmost position, panel 32 is free to pivot about abutment ends 88. Access panel 32 thus offers ready access to carrier 48 for mounting and changing blades without requiring separate tools or dismantling of handle 12.

As illustrated in FIGS. 2 and 3, utility knife 10 also includes a rear storage compartment 96 for spare blades 98. Storage compartment 96 is pivotally mounted within gripping section 16 of handle 12 during assembly of knife 10 and is movable between an exposed or open position (see FIG. 2), wherein spare blades can be stored or removed from the compartment, and closed position (see FIG. 3), wherein compartment 96 fits completely within handle 12. As illustrated in the FIGURES, compartment 96 includes a blade support panel 100, a lower support ledge 102, a curved upper ledge 104, a blade retaining peg 106, a pivot hinge 108 having a central aperture 110, and a retaining clasp 112. Hinge pins 114 protrude from left and fight halves L, R of handle 12 and enter into aperture 110. Left and fight halves L,R of handle 12 also include a latching surface 116 that cooperates with clasp 112 to hold compartment 96 in its closed position. Reliefs 118 are formed in left and right halves L, R to permit upper ledge 104 to be grasped for unlatching clasp 1112 and swinging compartment 96 into its open position. Once in the open position, spare blades 98 may be mounted in or removed from the compartment. Blades 98 placed in compartment 96 rest against panel 100 on lower support ledge 102 and are held in place by retaining tabs 120 projecting upwardly from ledge 102 and by a retaining lip 122 projecting downwardly from retaining peg 106.

The preferred structure of carrier 48 and actuator 50 will now be discussed with particular reference to FIGS. 5 through 8. As best illustrated in FIGS. 5 and 6, carrier 48 includes a support panel 124 and, as discussed above, projections 52 for engaging blades placed in the carrier, a lower ledge 56 for supporting the blades and a rear extension or tab 62 for coupling carrier 48 to actuator 50. In addition to these features, carrier 48 includes a first rear blade stop 126 supported on a cantilevered arm 128, a second rear blade stop 130, an aperture 132 for receiving carrier guard 60 (not shown in FIGS. 5 or 6) and a retaining lip 134 for holding carrier guard 60 in place as discussed be, low. First and second blade stops 126 and 130 project laterally from arm 128 and panel 124 respectively to engage a rear edge of short and long blades of the type commonly available commercially. In a manner generally known in the art, short blades placed in carrier 48 contact first rear blade stop 126, while long blades contact second rear blade stop 130, pressing laterally against first rear blade stop 126 to deflect cantilevered arm 128.

As discussed above, actuator 50 includes a substantially rigid actuating arm 64 having an end 66 configured for coupling to a pin 68 on tab 62 of carrier 48. In the preferred embodiment illustrated, two identical pins 68 are molded integrally on tab 62 and end 66 forms a clevis having apertures 136 for receiving pins 68. Alternatively, tab 62 could be formed with an aperture designed to align with apertures 136 and a separate pivot pin could be inserted through the aligned apertures to couple carrier 48 to actuator 50. Actuator 50 also includes support 70, extension 72 supporting button 30, projections 76 and resilient member 74. As best illustrated in FIG. 6, resilient member 74 extends from actuating arm 64 below support 70 and includes resilient extension 138 terminating in a yoke 140 having lateral extensions 142. When installed in handle 12, extensions 142 contact and ride on actuator glideway 82. The inherent resilience of extension 138 provides an upwardly directed reaction force urging support 70, projections 76 and button 30 toward upper wall 78 (see FIG. 3).

Figure 7:
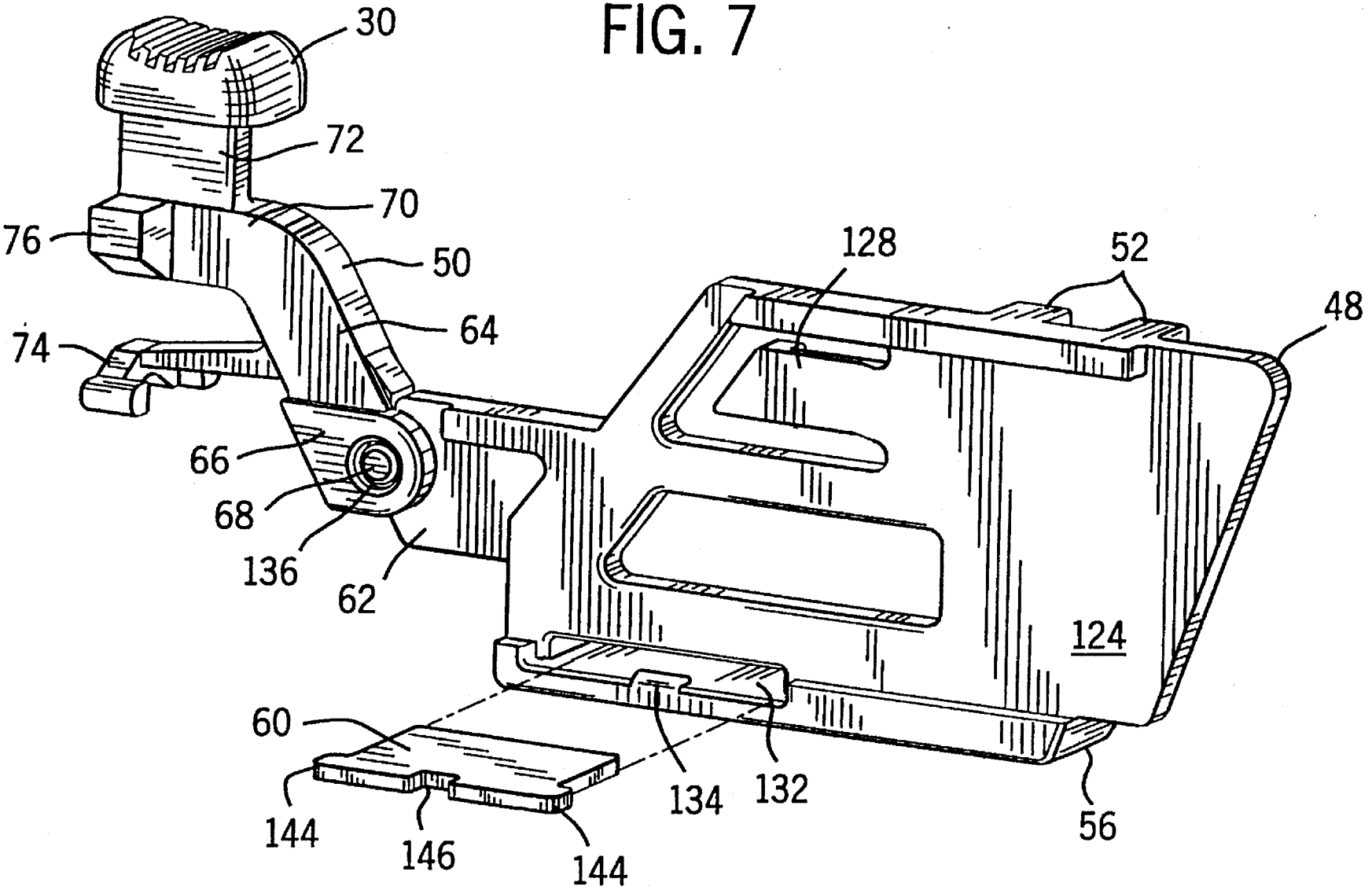
FIG. 7 is a front perspective view of the blade carrier and actuating arm illustrated in FIG. 5, showing the preferred arrangement of the carrier guard and how the carrier guard is inserted and secured to the carrier.

Carrier guard 60 is inserted into carrier 48 as illustrated in FIGURE 7. In the preferred embodiment, carrier guard 60 is formed, such as by stamping, with a pair of lateral stops 144 and a central relief 146. Carrier guard 60 is inserted into aperture 132 in carrier 48 from the side of carrier 48 opposite support ledge 56. For insertion, guard 60 is pressed into aperture 132, deflecting retaining lip 134 slightly, until stops 144 contact panel 124 on either side of aperture 132 and retaining lip 134 snaps upwardly, engaging central relief 146.

Figure 8:
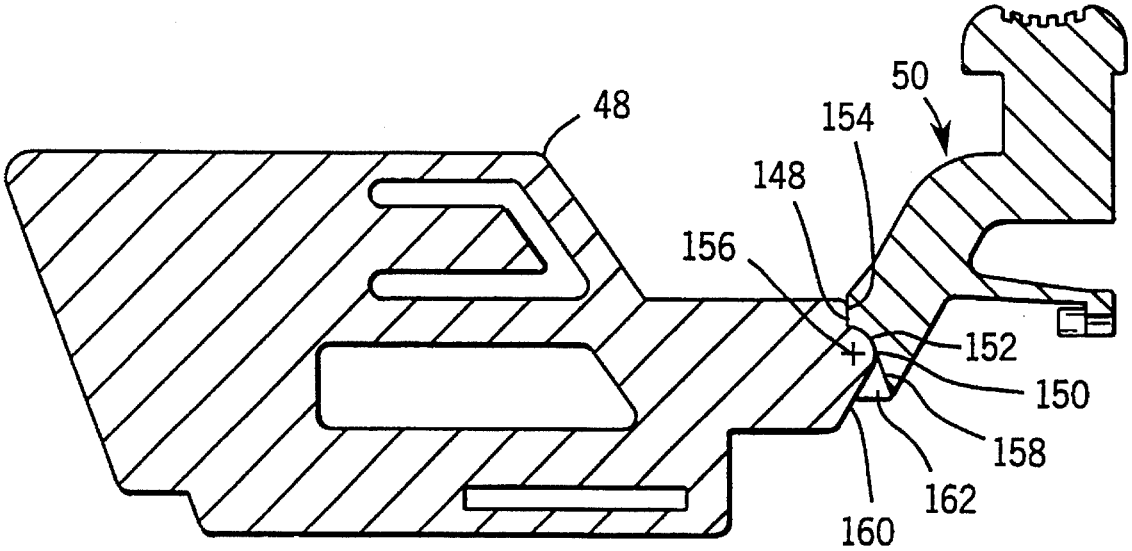
FIG. 8 is a sectional view of the blade carrier and actuating arm shown in FIG. 5 through section 8—8, illustrating the preferred structure for joining the actuating arm to the blade carrier and for transmitting force between the blade carrier and actuating arm.

While carrier 48 and actuator 50 are pivotally connected by engaging pins 68 into apertures 136, transmitting compressive axial forces exerted on blade 14 through pins 68 could weaken or even fracture the pins or the end 66 of actuating arm 64, or both. To avoid exerting excessive forces on pins 68, tab 62 and actuating arm 64 are provided with mating abutment surfaces 148 and 150 respectively as illustrated in FIG. 8. The contours of abutment surfaces 148 and 150 are substantially identical and include a circular cylindrical section 152 and a flat section 154 adjoining cylindrical section 152. Cylindrical section 152 of abutment surfaces 148 and 150 share a common rotational axis 156. Below cylindrical section 152, actuating arm abutment surface 150 joins a rearwardly directed surface 158, while from the same point carrier abutment surface 148 joins a forwardly directed surface 160. Surfaces 158 and 160 diverge from one another to create a free space 162 therebetween.

As actuator 50 and carrier 48 are moved between their blade-extended and blade-retracted positions as discussed above, cylindrical sections 152 of abutment surfaces 148 and 150 slide on one another about axis 156. In particular, because actuator glideway 82 and carrier glideway 61 diverge in the direction of front end 24, as actuator 50 and carrier 48 are moved rearwardly toward their blade-retracted positions, surfaces 158 and 160 move toward one another, closing space 162 and flat sections 154 of abutment surfaces 148 and 150 are separated from one another. In all positions intermediate to the fully extended and fully retracted positions, axial compression forces on a blade in carrier 48 are transmitted to actuator 50 through the cylindrical section of abutment surfaces 148 and 150. Abutment surfaces 148 and 150 are preferably configured such that at the position corresponding to full extension of blade 14, actuator 50 and carrier 48 are oriented with respect to one another such that flat sections 154 of abutment surfaces 148 and 150 contact one another as shown in FIG. 8. Thus, at the fully extended position, which will typically be the position in which blade 14 is most frequently used, axial forces on the blade are transmitted to actuator 50 by both flat sections 154 and cylindrical sections 152 of abutment surfaces 148 and 150, respectively.

While the invention is susceptible to various modifications and alternative forms, specific embodiments shown in the drawings and described in detail herein are offered by way of example only. However, it should be understood that the invention is not intended to be limited to the particular forms disclosed. Rather, the invention is to cover all modifications, equivalents and alternatives falling within the spirit and scope of the invention as defined by the appended claims. For example, while in the preferred embodiments the slot through which actuating button 30 protrudes is provided along the upper edge of the knife handle, certain of the advantageous features described above could be incorporated in a knife having an actuating slot in one, or both sides of the handle.

What is claimed is:

1. A utility knife of the type adapted to support a retractable blade having an upper non-cutting edge and a lower cutting edge, the utility knife comprising:

a handle having an internal cavity for housing the retractable blade, a first slot in an end thereof through which the blade may be extended and retracted, and a carrier glideway extending within the cavity from the first slot, the first slot having opposed first and second lateral sides and opposed upper and lower edges extending between the first and second sides;

a blade guard secured to the handle and extending along the upper edge and over at least a portion of the first and second sides of the first slot;

a blade carrier configured to support the blade and movable along the carrier glideway within the cavity; and an actuator including an actuating arm pivotally coupled to the blade carrier and an actuating button, the actuating button being movable along an elongated second slot in the handle to extend and retract the blade, the actuator also including a protrusion extending therefrom and engagable in notches within the handle for selectively securing the blade in extended and retracted positions.

2. The utility knife of claim 1, wherein the blade guard forms a closed loop surrounding a portion of the blade when the blade is in an extended position.

3. The utility knife of claim 1, wherein the handle is made of a moldable plastic material and the blade guard is made of a metallic material.

4. The utility knife of claim 1, further comprising an access panel pivotally mounted on the handle and movable between a closed position wherein the access panel overlies the blade carrier and an open position wherein the blade carrier is accessible for loading and unloading a blade, the blade guard being supported on the access panel.

5. The utility knife of claim 4, wherein the access panel is adapted for locking in the closed position.

6. The utility knife of claim 4, wherein the access panel includes at least one internal rib projecting from an inner surface thereof to a point lying adjacent and effectively in contact with a blade supported in the blade carrier when the access panel is in the closed position.

7. A utility knife comprising:

a handle having an internal cavity for housing a retractable blade, a first slot in an end thereof through which the blade may be extended and retracted, and a carrier glideway extending within the cavity from a point adjacent to the first slot;

a blade carrier configured to support the blade and movable along the carrier glideway within the cavity; and an actuator including a substantially rigid actuating arm having an end pivotally coupled to the blade carrier and an actuating button, the actuating button being movable along an elongated second slot in the handle to extend and retract the blade, the actuator also including a protrusion extending therefrom and engagable in notches within the handle for selectively securing the blade in extended and retracted positions.

8. The utility knife of claim 7, wherein the handle further includes an actuator glideway parallel to the second slot and the actuator includes a resilient support in contact with the actuator glideway for urging the protrusion into engagement with the notches.

9. The utility knife of claim 8, wherein the actuator glideway extends in a direction generally non-parallel to the carrier glideway.

10. The utility knife of claim 7, wherein the actuator is coupled to the blade carrier by a pivot pin.

11. The utility knife of claim 7, wherein the second slot is formed along an upper edge of the handle.

12. The utility knife of claim 7, wherein the blade carrier and the actuator include mating abutment surfaces for transmitting axial forces exerted on the blade to the actuating arm.

13. A utility knife comprising:

a handle having an internal cavity for housing a retractable blade, a first slot in an end thereof through which the blade may be extended and retracted, a carrier glideway extending within the cavity from a point adjacent to the first slot and an actuator glideway extending in a non-parallel orientation with respect to the carrier glideway;

a blade carrier configured to receive the, blade and movable along the carrier glideway within the cavity; and an actuator pivotally coupled to the blade carrier and supported on the actuator glideway, a portion of the actuator extending through an elongated second slot in the handle for selectively extending and retracting the blade, the actuator being slidable along the actuator glideway and substantially maintaining a predetermined orientation with respect to the actuator glideway as the actuator is moved between a blade-extended position and a blade-retracted position.

14. The utility knife of claim 13, wherein the actuator glideway has an arcuate configuration.

15. The utility knife of claim 13, wherein the actuator includes a substantially rigid actuating arm having a first end coupled to the blade carrier by a pivot pin and a second end resiliently supported on the actuator glideway.

16. The utility knife of claim 13, wherein the actuator glideway has a front extremity proximate the first slot and a rear distal extremity spaced from the first slot and wherein from the rear extremity to the front extremity the actuator glideway diverges from the carrier glideway.

17. The utility knife of claim 13, wherein the actuator glideway has a front extremity proximate the first slot and a rear distal extremity spaced from the first slot and wherein from the rear extremity to the front extremity the actuator glideway converges toward the carrier glideway.

18. A utility knife of the type adapted to support a retractable blade having an upper non-cutting edge and a lower cutting edge, the utility knife comprising:

a handle having an internal cavity for housing a retractable blade, a first slot in an end thereof through which the blade may be extended and retracted, and a carrier glideway extending within the cavity from the first slot;

a blade carrier configured to support the blade and movable along the carrier glideway within the cavity, the blade carrier including a lower ledge for supporting the cutting edge of the blade;

a carrier guard disposed on the blade carrier adjacent to the lower ledge thereof for contacting the cutting edge of the blade; and an actuator including an actuating arm having an end pivotally coupled to the blade carrier, a portion of the actuator extending through an elongated second slot in the handle and movable along the second slot to selectively extend and retract the blade, the actuator also including a protrusion extending therefrom and engagable in notches within the handle for selectively securing the blade in extended and retracted positions.

19. The utility knife of claim 18, wherein the carrier is made of a moldable plastic material and the carrier guard is made of a metallic material.

20. The utility knife of claim 18, wherein the blade carrier includes an aperture adjacent to the lower ledge thereof and wherein the carrier guard comprises an insert received within the aperture.

21. The utility knife of claim 20, wherein the blade carrier includes a projection adjacent to the aperture for contacting the carrier guard to retain the carrier guard in the aperture.

22. A utility knife comprising:

a handle having an internal cavity for housing a retractable blade, a first slot in an end thereof through which the blade may be extended and retracted, and a carrier glideway extending within the cavity from a point adjacent to the first slot;

a blade carrier configured to support the blade and movable along the carrier glideway within the cavity, the blade carrier including a first abutment surface for transmitting forces exerted on the blade to an actuator; and an actuator including an actuating arm and an actuating button, the actuating arm being pivotally coupled to the blade carrier at a pivot joint, the actuating button being movable along an elongated second slot in the handle to extend and retract the blade, the actuator also including a protrusion extending therefrom and engagable in notches within the handle for selectively securing the blade in extended and retracted positions, the actuator further including a second abutment surface separate from the pivot joint and configured to contact the first abutment surface to accept from the blade carrier forces exerted on the blade from the blade carrier.

23. The utility knife of claim 22, wherein the first and second abutment surfaces include cylindrical sections sharing a common rotational axis and flat sections adjoining the cylindrical sections.

24. The utility knife of claim 23, wherein the blade carrier and the actuator are movable between a blade-extended position and a blade-retracted position and wherein only the cylindrical sections abut one another in the blade-retracted position and both the cylindrical sections and the flat sections abut one another in the blade-extended position.

* * * * *